US006080017A

United States Patent [19]

Yu et al.

[11] Patent Number: 6,080,017

[45] Date of Patent: Jun. 27, 2000

[54] ELECTRICAL CARD CONNECTOR

[75] Inventors: Hung-Chi Yu, Hsi-Chih; Ming-Chun Lai, Shin-Juang, both of Taiwan

[73] Assignee: Hon Hai Precision Ind. Co., Ltd., Taipei Hsien, Taiwan

[21] Appl. No.: 09/329,093

[22] Filed: Jun. 9, 1999

[30] Foreign Application Priority Data

Dec. 28, 1998 [TW] Taiwan ..... 87221635

[51] Int. Cl.[7] ..... H01R 13/648

[52] U.S. Cl. ..... 439/607; 439/377

[58] Field of Search ..... 439/64, 377, 607

[56] References Cited

U.S. PATENT DOCUMENTS 5,591,050 1/1997 Sueoka ..... 439/607
5,807,137 9/1998 Janota et al. ..... 439/607
5,993,257 11/1999 Maruyama ..... 439/607
6,033,236 3/2000 McHugh et al. ..... 439/74

*Primary Examiner*—Michael L. Gellner
*Assistant Examiner*—Mahmoud Anwar A. Mohamed
*Attorney, Agent, or Firm*—Wei Te Chung

[57] ABSTRACT

An electrical card connector comprises an insulative housing, a number of terminals received in the housing, a shield attached to the housing and two stand-off devices attached to opposite sides of the shield. Each stand-off device comprises two locking latches outwardly extending from leading arms of the shield and a stand-off section. The stand-off section comprises a main body and a base extending from a bottom portion thereof. Locking slots are formed in the body for retaining the corresponding locking latches therein. Spring arms are formed in the body and each has a folded free end proximate the corresponding locking slot for engaging with the corresponding locking latch. Thus, the stand-off device is easily and securely attached to the shield of the card connector.

9 Claims, 4 Drawing Sheets

ELECTRICAL CARD CONNECTOR

BACKGROUND OF THE INVENTION

The present invention relates to an electrical card connector, and particularly to an electrical card connector having an improved stand-off device.

Electrical card connector is commonly mounted on a main board by soldering. In order to prevent liquid solder from entering an inner portion of the electrical card connector, a stand-off device is positioned on a bottom portion thereof. Related inventions are disclosed in Taiwan Patent Application Nos. 83215629 and 83218076.

Referring to FIG. 1, a conventional stand-off device 2 of an electrical card connector 3 is positioned on each of opposite ends of each leading arm 30 thereof. One end of the stand-off device 2 is an engaging end 21 and the other end of the stand-off device 2 is a supporting end 22. The diameter of the supporting end 22 is larger than that of the engaging end 21. The engaging end 21 of the stand-off device 2 is retained in a corresponding receiving hole 1 defined in the leading arm 30; thus, the electrical card connector can be securely attached on the circuit board.

Since opposite ends of the conventional stand-off device 2 have different diameters and the engaging end 21 is fittingly engaged within the receiving hole 1, the stand-off device 2 must be precisely shaped by spinning, drilling and other processes. Thus, the manufacturing process is laborious and costly. Furthermore, the conventional stand-off device is engaged with the insulative leading arm which does not provide electromagnetic shielding. Hence, there is a need for a stand-off device which can be easily manufactured and assembled.

BRIEF SUMMARY OF THE INVENTION

Accordingly, an object of the present invention is to provide an electrical card connector having a stand-off device which can be easily and securely assembled thereto.

To fulfill the above-mentioned object, according to a preferred embodiment of the present invention, an electrical card connector comprises an insulative housing, a plurality of terminals received in the housing, a shield attached to the housing and two stand-off devices attached to opposite sides of the shield. The shield covers the housing and two leading arms extending from opposite sides of the shield. Each stand-off device comprises two locking latches outwardly extending from each leading arm of the shield, and a stand-off section. The stand-off section comprises a main body and a base extending from a bottom portion thereof. Locking slots are formed in the body for retaining the corresponding locking latches therein. Spring aims are formed in the body and each has a folded free end proximate the corresponding locking slot for engaging with the corresponding locking latch. Thus, the stand-off device is easily and securely attached to the shield of the card connector.

DETAILED DESCRIPTION OF THE INVENTION

Figure 1:
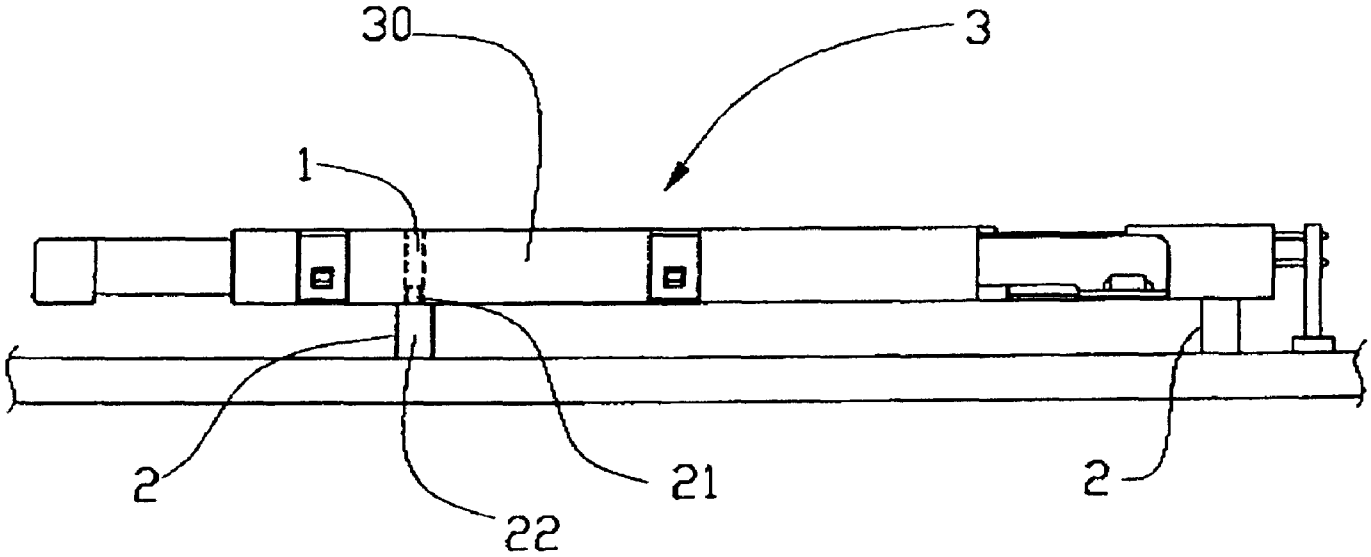
FIG. 1 (PRIOR ART)
FIG. 1 is a side view of a conventional electrical card connector having stand-off devices.
Figure 2:
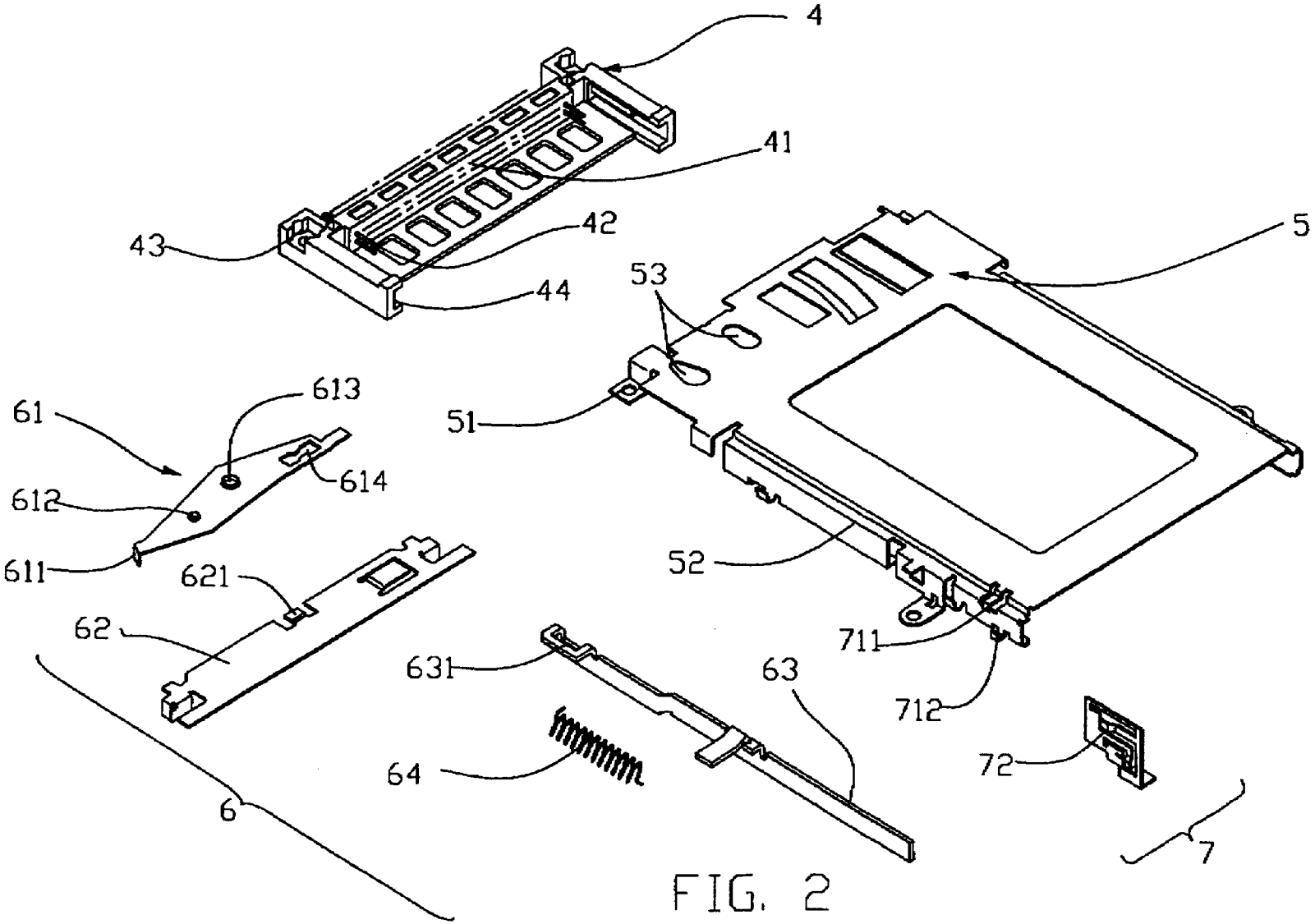
FIG. 2 is an exploded perspective view of an electrical card connector in accordance with the present invention.
Figure 3:
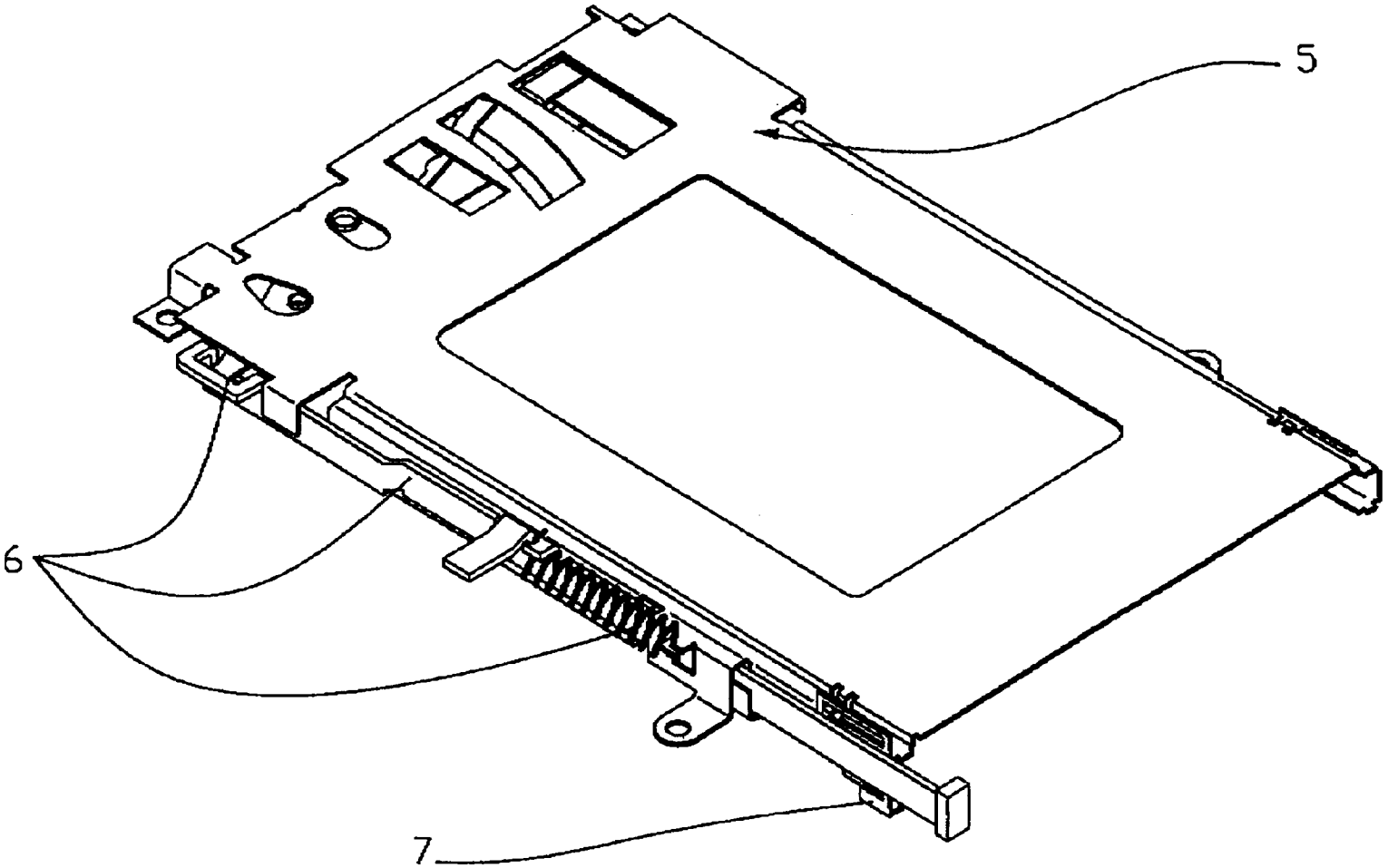
FIG. 3 is an assembled view of FIG. 2.

Referring to FIGS. 2 and 3, an electrical card connector in accordance with a preferred embodiment of the present invention comprises an insulative housing 4, a shield 5, a card ejection mechanism 6 and a stand-off device 7. A plurality of passageways 41 are defined in the insulative housing 4 for receiving a plurality of terminals 42 therein. Two locking recesses 43 are provided at opposite ends of the housing 4 for engaging with tabs 51 extending from a front portion of the shield 5. Two channels 44 are defined in the housing 4 facing each other for supporting an electrical card (not shown) therebetween. The shield 5 covers the insulative housing 4, and two leading arms 52 extend from opposite longitudinal sides of the shield 5.

The card ejection mechanism 6 is positioned within the shield 5 and includes an actuator 61, an ejection plate 62, a push rod 63 and a spring 64. The push rod 63 forms an opening 631 at a free end thereof for engaging with a locking tab 611 formed at free end of the actuator 61. An engaging tab 621 of the ejection plate 62 engages with a slot 614 of the actuator 61. Two pivots 612, 613 of the actuator 61 engage with corresponding holes 53 of the shield 5.

Figure 5:
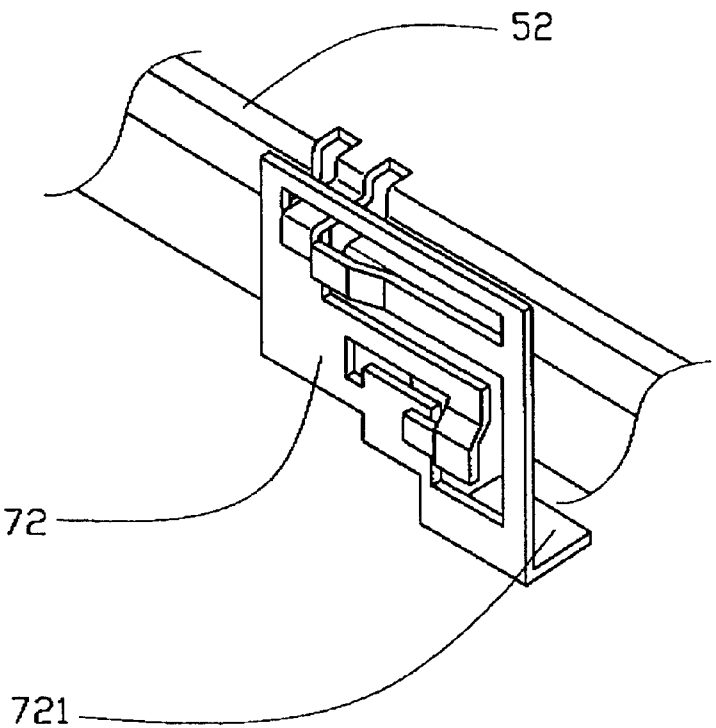
FIG. 5 is a perspective view of the stand-off device assembled to the electrical card connector.
Figure 4:
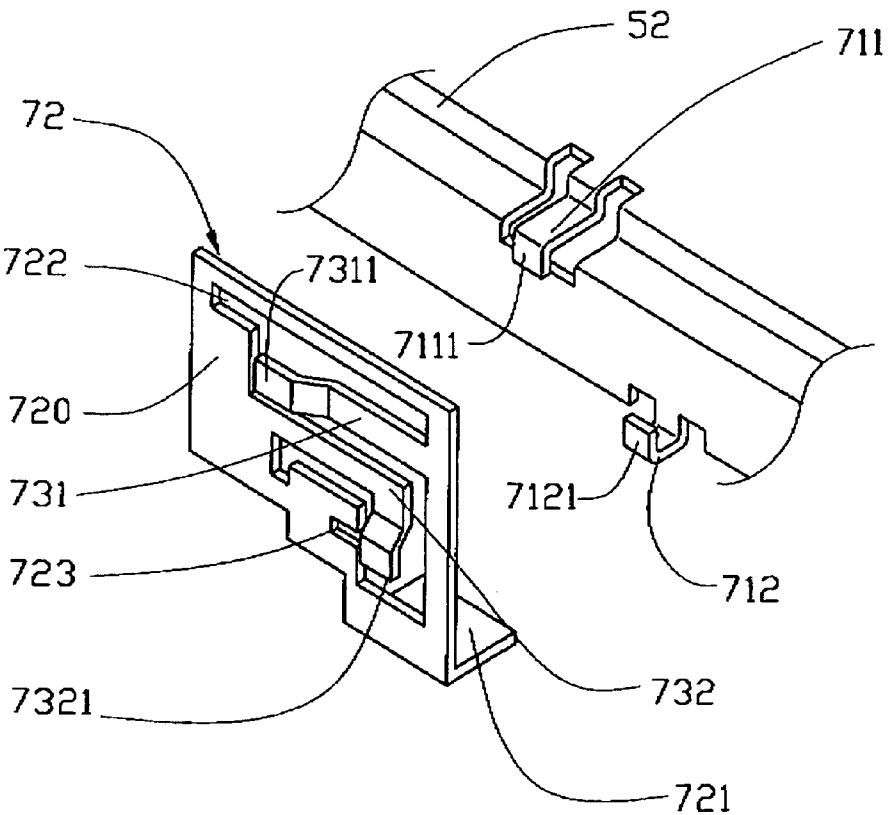
FIG. 4 is an enlarged exploded view of the stand-off device of the present invention.

Referring to FIGS. 4 and 5, the stand-off device 7 is attached to opposite sides of the shield 5 at a rear end thereof. Each stand-off device 7 comprises a first locking latch 711, a second locking latch 712, and a stand-off section 72. The first locking latch 711 downwardly extends from an upper portion of the shield 5 and the second locking latch 712 upwardly extends from a lower edge of the leading arm 52 thereof. The stand-off section 72 is formed by stamping and folding a plate. The stand-off section 72 comprises a vertical main body 720 and a base 721 perpendicularly extending from a bottom portion thereof. A first locking slot 722 and a second locking slot 723 are defined in the body 720 of the stand-off section 72 for receiving the first locking latch 711 and the second locking latch 712, respectively. A first spring arm 731 and a second spring arm 732 are formed in the body 720. Each spring arm 731, 732 has a folded free end 7311, 7321 proximate the corresponding locking latch 711, 712 and extending slightly beyond an outer surface of the body 720. Free ends 7111, 7121 of the first and second locking latches 711, 712 are extending away from the leading arms. So the side edge of folded free end 7311, 7321 will contact with the free ends 7111, 7121 of the corresponding first and second locking latches 711, 712.

In assembly, the first and second locking latches 711, 712 extend through the first and second locking slots 722, 723, respectively. The folded free ends 7311, 7321 engage with the corresponding locking latches 711, 712 to securely attach the stand-off section 72 to the shield 5. After the card connector is fully assembled, solder is applied to the base 721 of the stand-off section 72 to mount the card connector to a circuit board (not shown).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

an insulative housing defining a plurality of passageways for receiving terminals therein;

a shield covering the housing and having two leading arms extending in a longitudinal direction, each leading arm having a first locking latch and a second locking latch; and a stand-off section engageable with the first and second locking latches along the longitudinal direction.

2. The electrical card connector as claimed in claim 1, wherein the first locking latches downwardly extends from the leading arm and the second locking latch upwardly extends from the leading arm.

3. The electrical card connector as claimed in claim 1, wherein the stand-off section comprises a vertical body and a base extending from a bottom portion thereof, a first locking slot and a second slot being formed in the body for respectively receiving the first and second locking latches therein, and a first spring arm and a second spring arm formed in the body for preventing the first and second locking latches from disengaging the first and second slots, respectively.

4. The electrical card connector as claimed in claim 3, wherein the first and the second locking slots are parallel to each other.

5. The electrical card connector as claimed in claim 3, wherein the first and second spring arms each has a free end offset from an outer surface of the vertical body.

6. The electrical card connector as claimed in claim 3, wherein respective free ends of the first and the second locking latches abut end-to-end with respective folded free ends of the first and second spring arms, respectively.

7. An electrical connector comprising:

an insulative housing comprising a plurality of terminals therein;

a shield covering the housing and including at least one leading arm extending in a longitudinal direction, said leading arm forming a locking latch thereon extending laterally and outwardly; and a stand-off section including a vertical main body for spacing the connector from a printed circuit board on which the connector is seated, and a horizontal base inwardly extending toward the corresponding leading arm, whereby said locking latch is latchably engaged with the vertical main body.

8. The connector as claimed in claim 7, wherein the main body defines a locking slot for latchable engagement with the corresponding locking latch.

9. The connector as claimed in claim 7, wherein the main body further includes a spring arm for abutment against the corresponding locking latch.

* * * * *